US005133171A

United States Patent [19]

Chase et al.

[11] Patent Number: 5,133,171

[45] Date of Patent: Jul. 28, 1992

[54] LIGHT-TIGHT PACKAGING METHOD FOR PHOTOSENSITIVE WEB ROLL

[75] Inventors: Gregory A. Chase, Fairport; Luke T. Faulstick; Michael L. Koelsch, both of Rochester, all of N.Y.

[73] Assignee: Eastman Kodak Company, Rochester, N.Y.

[21] Appl. No.: 784,848

[22] Filed: Oct. 30, 1991

[51] Int. Cl.[5] ..... B65B 25/24; B65B 63/04; B65B 11/04; B65D 85/67

[52] U.S. Cl. ..... 53/409; 53/412; 53/419; 53/430; 53/462; 53/465; 206/400; 206/414

[58] Field of Search ..... 53/412, 419, 430, 462, 53/465, 118, 372.8, 372.9, 284, 284.2, 409; 242/164, 165, 7.02; 206/389, 400, 413, 414

[56] References Cited

U.S. PATENT DOCUMENTS

| | | | |
|---|---|---|---|
| 1,848,119 | 3/1932 | Fairchild | 53/465 X |
| 2,883,045 | 4/1959 | Abramson | 206/59 |
| 2,893,190 | 7/1959 | Lancaster | 53/372.9 |
| 3,633,335 | 1/1972 | Johnson | 53/372.9 |
| 3,998,325 | 12/1976 | Kulka | 206/400 |
| 4,014,155 | 3/1977 | Izawa et al. | 53/465 |
| 4,137,690 | 2/1979 | Morgan | 53/372.9 X |
| 4,148,395 | 4/1979 | Syracuse et al. | 206/414 |
| 4,296,857 | 10/1981 | Huck | 206/400 X |
| 4,505,387 | 3/1985 | Seto | 206/414 |
| 4,534,151 | 8/1985 | Schneck et al. | 53/419 X |
| 4,733,777 | 3/1988 | VanGeyte et al. | 206/400 X |
| 4,911,299 | 3/1990 | Peeters | 53/409 X |
| 4,928,454 | 5/1990 | Bertolotti | 53/409 |
| 5,049,928 | 9/1991 | Tirone | 206/414 X |

*Primary Examiner*—Horace M. Culver
*Attorney, Agent, or Firm*—Clyde E. Bailey

[57] ABSTRACT

A package light-tightly enclosing a photosensitive web roll for use in cooperating apparatus comprises an opaque leader joined to the web and wrapped circumferentially at least twice around the roll and a pair of thin, readily foldable, disk-shaped, opaque end caps covering the roll ends. Each end cap has an inner annular portion that is folded into and sealed inside one of the roll core ends and an outer annular portion that is folded over the corresponding roll end periphery and onto the adjacent lateral edge portion of the first leader convolution. A pair of opposite lateral edge portion recesses extend inwardly from the leader opposite lateral edges, by an amount slightly exceeding the folded-over end-cap outer-annular-portion width, at a circumferential site on the leader where the first leader convolution ends. A narrower medial portion of the leader between those recesses can thus pass freely between the folded-over outer annular portions and thereby permit the second leader convolution to be wrapped circumferentially around the folded-over outer annular portions. The folded-over outer annular portions of both end caps are thus light-tightly trapped between the opposite lateral edge portions of the first and second leader convolutions, thereby light-tightly enclosing the web roll without having to seal or adhere the leader to the end caps, and without significantly increasing the web roll length.

10 Claims, 5 Drawing Sheets

LIGHT-TIGHT PACKAGING METHOD FOR PHOTOSENSITIVE WEB ROLL

CROSS-REFERENCE TO RELATED APPLICATION

Reference is made to commonly assigned, copending, related U.S. patent application Ser. No. 07/784,854, filed concurrently herewith in the names of Gregory A. Chase et al. and titled LIGHT-TIGHT PACKAGE FOR PHOTOSENSITIVE WEB ROLL.

BACKGROUND OF THE INVENTION

1. Field of the Invention

The present invention relates generally to packaging of photosensitive material, and particularly to a packaging method for light-tightly enclosing and dispensing a roll of photosensitive web material.

2. Description of the Prior Art

Currently, roll film and paper are packaged for room-light loading into cooperating apparatus in two different ways. One utilizes plastic end plugs for light-shielding the roll ends together with an opaque plastic leader that is wrapped circumferentially around the roll and then withdrawn after the roll has been placed in a light-safe environment. Because those end plugs increase the roll axial length, it has been necessary to modify certain using apparatus in order to accomodate the increased length. Such modification has proven inconvenient and costly for the user. The other way, described in U.S. Pat. No. 4,911,299, avoids use of end plugs by instead utilizing thin, flexible, disk-shaped end covers that are folded and heat-sealed to both the roll core ends and a laminated-plastic circumferential wrapper, the wrapper then being torn away from its end-cover seals after the roll has been secured in a light-safe environment. This approach avoids modifying the using apparatus, but the folding and sealing steps required in the packaging process are complex and costly for the manufacturer.

There has thus existed a need for a simpler, more practical, efficient, economical, and convenient alternative to the above methods, preferably such an alternative that obviates any modification of using apparatus and, as well, any sealing of a circumferential cover element to another part of the package, thereby benefiting both the user and the manufacturer.

SUMMARY OF THE INVENTION

The primary object of this invention has been to meet the foregoing need. That object and others have been achieved by the invention herein disclosed and claimed.

This invention finds utility in a method for light-tightly enclosing a roll of photosensitive material in a package that may be readily opened to dispense such material in cooperating apparatus. The roll includes an elongate photosensitive web of predetermined width that is wound longitudinally about a hollow cylindrical core and terminates in an outermost end thereof. The web so wound about the core defines both diametral and circumferential dimensions of the roll and circumferential and opposite end surfaces thereof. The core has opposite open ends defining an axial length therebetween that is substantially equal to the web predetermined width. Each of the core ends has an inner diameter that defines an inner circumferential surface extending axially inwardly from that end. This method comprises the steps of:

providing a flexible opaque leader having (1) leading and trailing ends that define a longitudinal dimension therebetween equal to at least twice the roll circumferential dimension, (2) opposite lateral edges that define a leader width therebetween substantially equal to the web predetermined width, (3) opposite lateral marginal portions that extend longitudinally along, and inwardly of, the opposite lateral edges respectively, and (4) a medial portion that extends longitudinally between the lateral marginal portions;

providing in each of the lateral marginal portions a recess that extends inwardly from the adjacent one of the lateral edges and that is spaced longitudinally from the trailing end by substantially the roll circumferential dimension;

joining the trailing end to the web outermost end;

winding a first stretch of the leader longitudinally about the roll circumferential surface through a first convolution of the leader which begins at its trailing end and ends at the recesses in its lateral marginal portions, leaving a second stretch of the leader as yet unwound;

providing a pair of foldable, disk-shaped, opaque end caps that are adapted to cover the roll opposite end surfaces respectively, each of the end caps including a central round opening therein, with a diameter less than the core inner diameter, and an annular opaque cover element that surrounds the opening and extends radially outwardly therefrom to a circular periphery, with a diameter greater than the roll diametral dimension, the cover element having both an inner annular marginal portion, which extends radially outwardly from the opening to an extent substantially commensurate with the core inner diameter, and an outer annular marginal portion, which extends radially inwardly from the periphery to an extent substantially commensurate with the roll diametral dimension;

placing each of the end caps in substantially concentric covering relation to a respective one of the roll opposite end surfaces;

folding the inner annular marginal portion of each end cap cover element axially inwardly inside the adjacent core end and then sealing that portion, so folded, to the inner circumferential surface of that end;

folding the outer annular marginal portion of each end cap cover element axially inwardly of the adjacent roll end surface and then radially inwardly upon the adjacent lateral marginal portion of the first leader convolution, the recesses in both lateral marginal portions providing sufficient clearance for the leader medial portion therebetween to pass between the folded outer annular marginal portions of both end cap cover elements at a circumferential point where the first leader convolution ends; and winding the as-yet-unwound second stretch of the leader longitudinally about the folded outer annular marginal portions, and the first leader convolution medial portion therebetween, through a second convolution of the leader begining at the recesses and ending a circumferential distance therebeyond equal to at least the roll circumferential dimension;

whereby the folded outer annular marginal portions of both end cap cover elements are light-tightly secured between respective lateral marginal portions of the first and second leader convolutions.

This invention, and its objects and advantages, will become more apparent in the detailed description of its preferred embodiment presented hereinbelow.

BRIEF DESCRIPTION OF THE DRAWINGS

In the detailed description of the preferred embodiment of this invention presented below, reference is made to the accompanying drawings, wherein like reference characters denote like elements, and wherein.

DESCRIPTION OF THE PREFERRED EMBODIMENT

Because certain parts of, and methods of making, photosensitive web roll packages are well known, the following description is directed in particular to those elements and method steps forming, cooperating directly with, or relating to, this invention. Elements and steps not specifically shown or described herein are selectable from those known in the relevant art.

Figure 1:
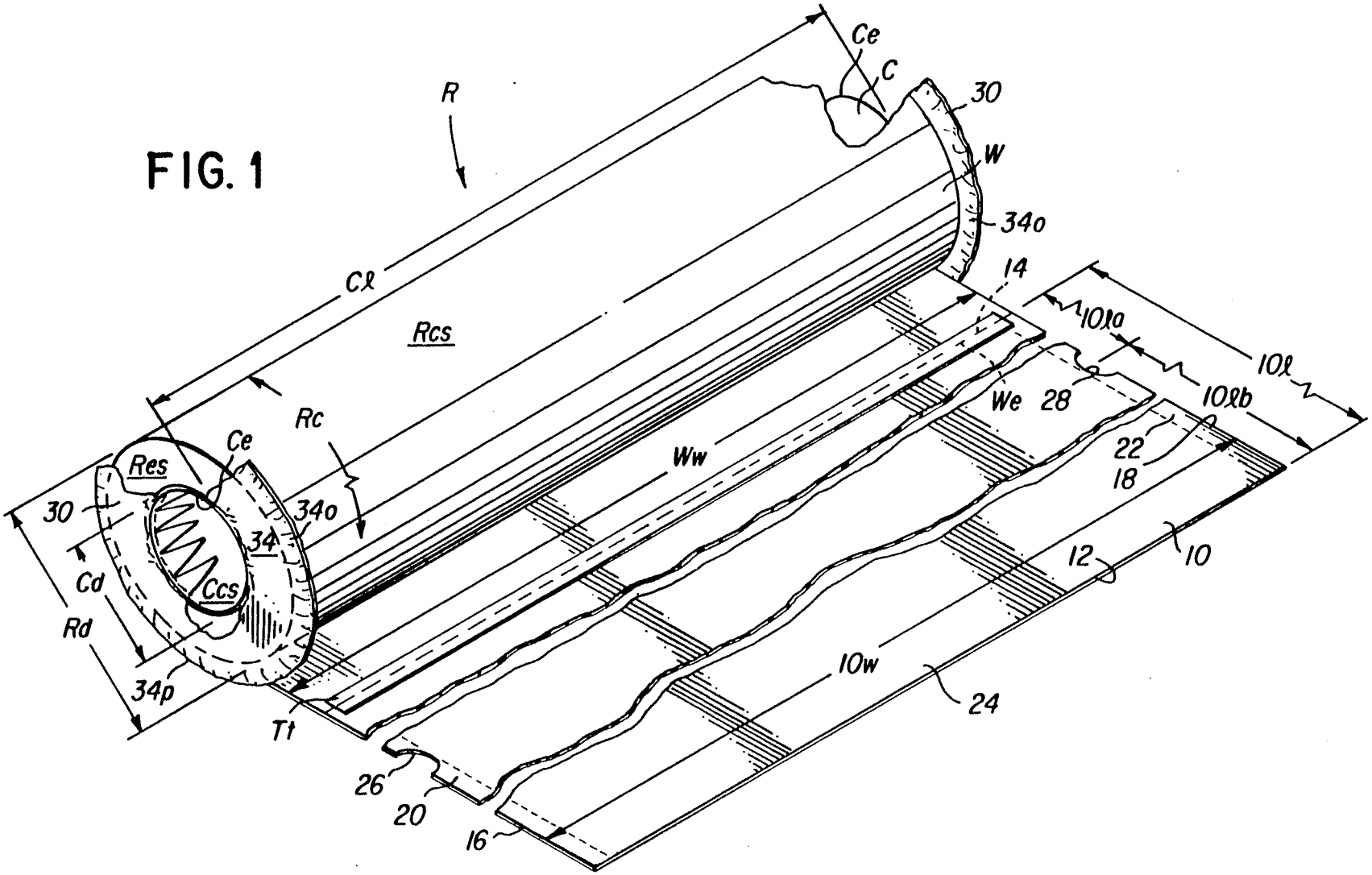
FIG. 1 is a perspective view of a photosensitive web roll, showing partially fragmented and broken-away components of a light-tight package according to this invention in an early stage of their application to the roll.

FIG. 1 illustrates a roll R of an elongate photosensitive web W of predetermined width Ww that is wound longitudinally about a hollow cylindrical core C and terminates in an outermost end We thereof. The web so wound about the core defines both diametral and circumferential dimensions Rd and Rc of the roll and circumferential and opposite end surfaces Rcs and Res thereof. The core has opposite open ends Ce defining an axial length Cl therebetween that is substantially equal to the web predetermined width Ww. Each of the core ends has an inner diameter Cd that defines an inner circumferential surface Ccs extending axially inwardly from that end.

Joined to the web outermost end We by an adhesive tape Tt is a flexible opaque leader 10 having leading and trailing ends 12 and 14 that define a longitudinal dimension 10*l* therebetween equal to at least twice the roll circumferential dimension Rc. Leader 10 also has opposite lateral edges 16 and 18 that define a leader width 10*w* therebetween substantially equal to the web predetermined width Ww. Included in leader 10 are opposite lateral marginal portions 20 and 22 that extend longitudinally along, and transversely inwardly of, the opposite lateral edges 16 and 18, respectively, and a medial portion 24 that extends longitudinally along, and transversely between, the lateral marginal portions 20 and 22.

Provided in the leader lateral marginal portions 20 and 22 are recesses, or notches, 26 and 28 that extend transversely inwardly from lateral edges 16 and 18, respectively, and that are spaced longitudinally from leader trailing end 14 by a first stretch 10*la* of the leader substantially equal in length to the roll circumferential dimension Rc. It will be noted that leader trailing end 14 is where leader 10 is joined by tape Tt to the web outermost end We.

Figure 2:
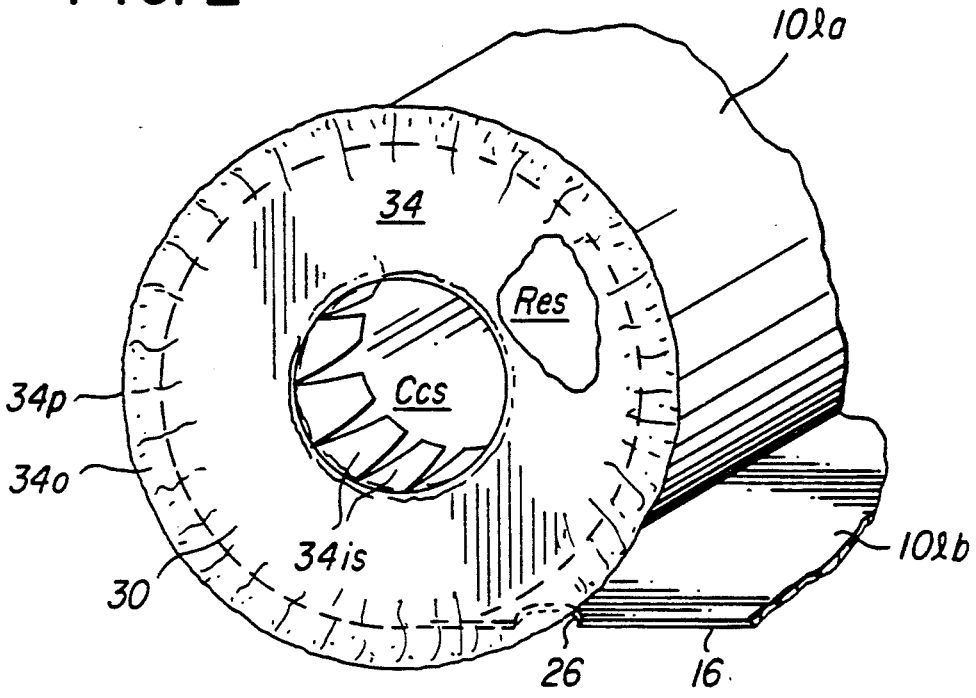
FIGS. 2–6 are partial perspective views of the web roll and package components shown in FIG. 1, illustrating portions of those components in succeeding stages of their application to the roll.

That first stretch 10*la* of leader 10 is wound longitudinally about the roll circumferential surface Rcs through a first leader convolution which begins at trailing end 14 and ends at recesses 26 and 28, leaving a second stretch 10*lb* of the leader as yet unwound, as illustrated in FIG. 2.

Figure 1A:
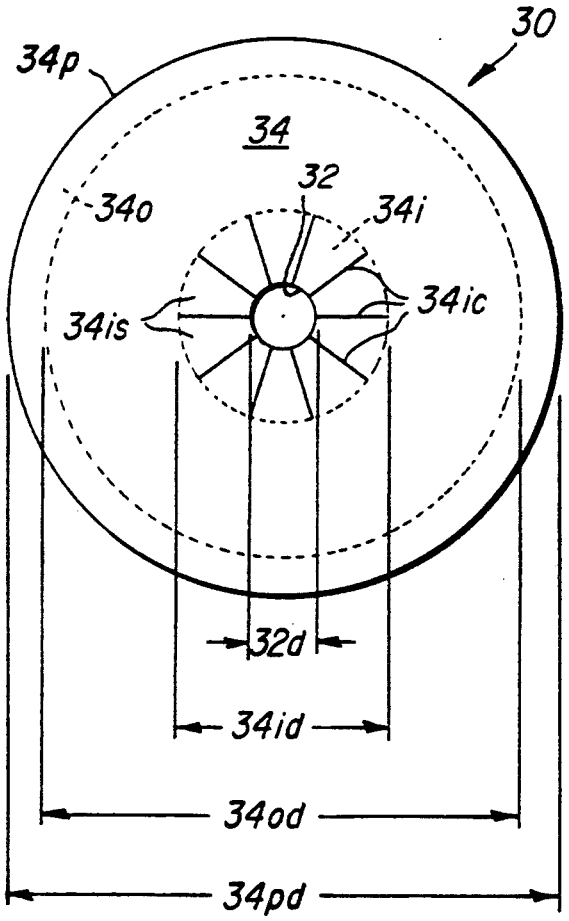
FIG. 1A is a plan view showing details of one of the package components before its application to the roll.

Covering the roll opposite end surfaces Res are a pair of identical, readily foldable, disk-shaped, opaque end caps 30. As depicted in FIG. 1A, each end cap 30 includes a central round opening 32 therein, with a diameter 32*d* less than the core inner diameter Cd, and an annular opaque cover element 34 that surrounds opening 32 and extends radially outwardly therefrom to a circular periphery 34*p* having a diameter 34*pd* greater than the roll diametral dimension Rd. Cover element 34 includes both an inner annular marginal portion 34*i*, which extends radially outwardly from opening 32 to an extent defined by an outer diameter 34*id* that is substantially commensurate with the core inner diameter Cd, and an outer annular marginal portion 34*o*, which extends radially inwardly from periphery 34*p* to an extent defined by an inner diameter 34*od* that is substantially commensurate with the roll diametral dimension Rd.

Referring back to leader 10, the lateral marginal portions 20 and 22 thereof can now be defined more particularly as extending inwardly from adjacent lateral edges 16 and 18, respectively, by an amount at least as great as the radial extent, or width, of the end cap cover element outer annular marginal portion 34*o*, i.e., at least $\frac{1}{2}$ (34*pd*-34*od*). And the recesses 26 and 28 in leader 10 can accordingly be defined as extending inwardly from edges 16 and 18 through the lateral marginal portions 20 and 22, respectively, at least to the medial portion 24 therebetween. That is to say, the recesses 26 and 28 extend inwardly from adjacent lateral edges 16 and 18, respectively, by an amount at least as great as, preferably slightly greater than, the radial extent, or width, of the outer annular marginal portion 34*o*, i.e., $\geqq \frac{1}{2}$ (34*pd*-34*od*). Each of the end caps 30 is placed in substantially concentric covering relation to a respective one of the roll opposite end surfaces Res. The inner annular marginal portion 34*i* of each end cap cover element 34 is folded axially inwardly inside the adjacent core end Ce and then sealed, preferably heat-sealed, to the inner circumferential surface Ccs of that end. Each inner annular marginal portion 34*i* is provided with means for facilitating such folding and sealing. The facilitating means may include a plurality of substantially radial lines of weakness in portion 34*i*, such as lines of cleavage 34*ic* which divide that portion into a plurality of separately foldable and sealable segments 34*is*, as shown in FIG. 1A. Preferably, such lines of cleavage are die-cut through portion 34*i*.

Figure 3:
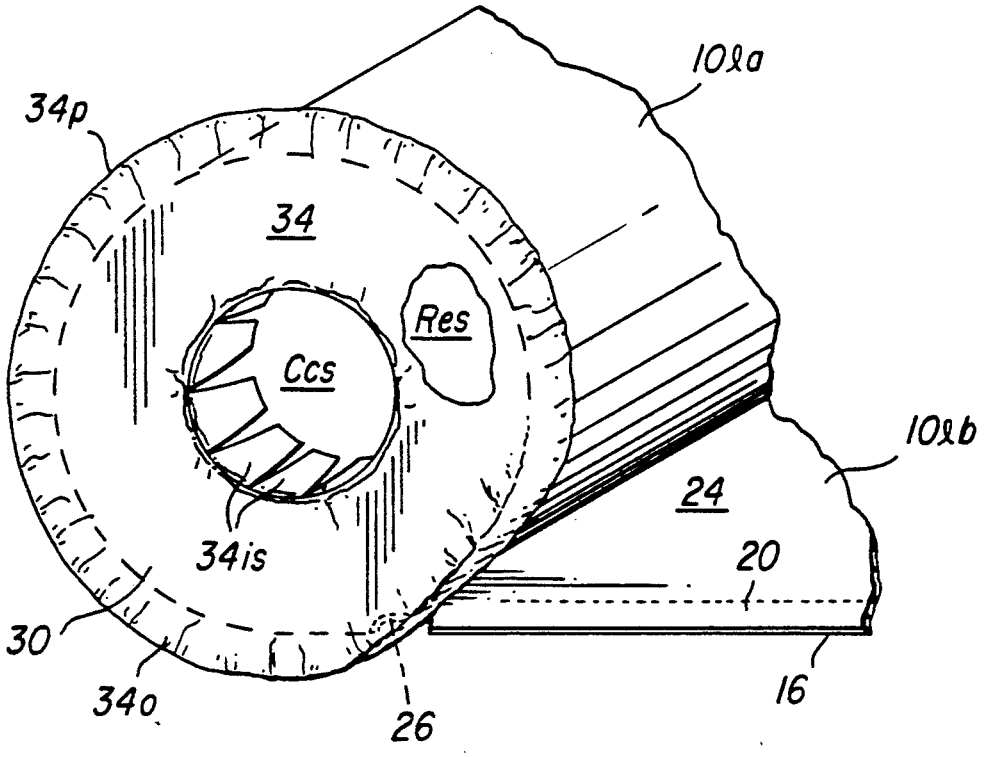

As illustrated in FIG. 3, the outer annular marginal portion 34*o* of each end cap cover element 34 is folded axially inwardly of the adjacent roll end surface Res and then radially inwardly upon the adjacent lateral marginal portion 20 or 22 of the aforementioned first leader convolution. The recesses 26 and 28 in both lateral marginal portions 20 and 22 provide sufficient clearance for the leader medial portion 24 therebetween to pass freely between the folded outer annular marginal portions 34*o* of both end cap cover elements 34 at a circumferential point where the first leader convolution ends.

Figure 4:
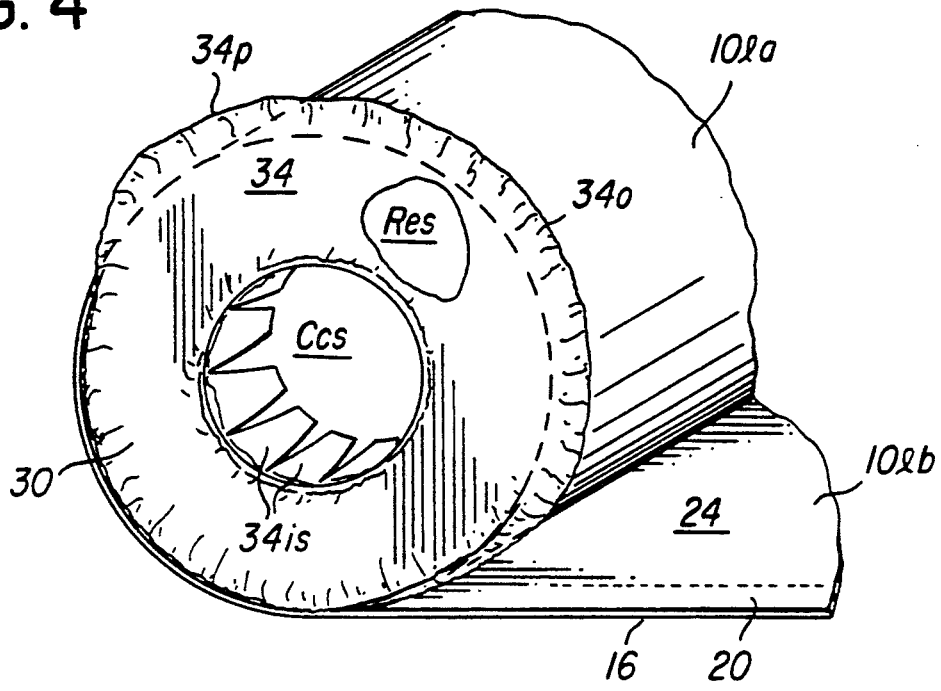

As depicted in FIG. 4, the aforementioned as-yet-unwound second stretch 10*lb* of leader 10 is then wound longitudinally about the folded end cap cover element outer annular marginal portions 34*o*, and the first leader convolution medial portion 24 therebetween, through a second leader convolution begining at the recesses 26 and 28 and ending a circumferential distance therebeyond equal to at least the roll circumferential dimension Rc.

Figure 5:
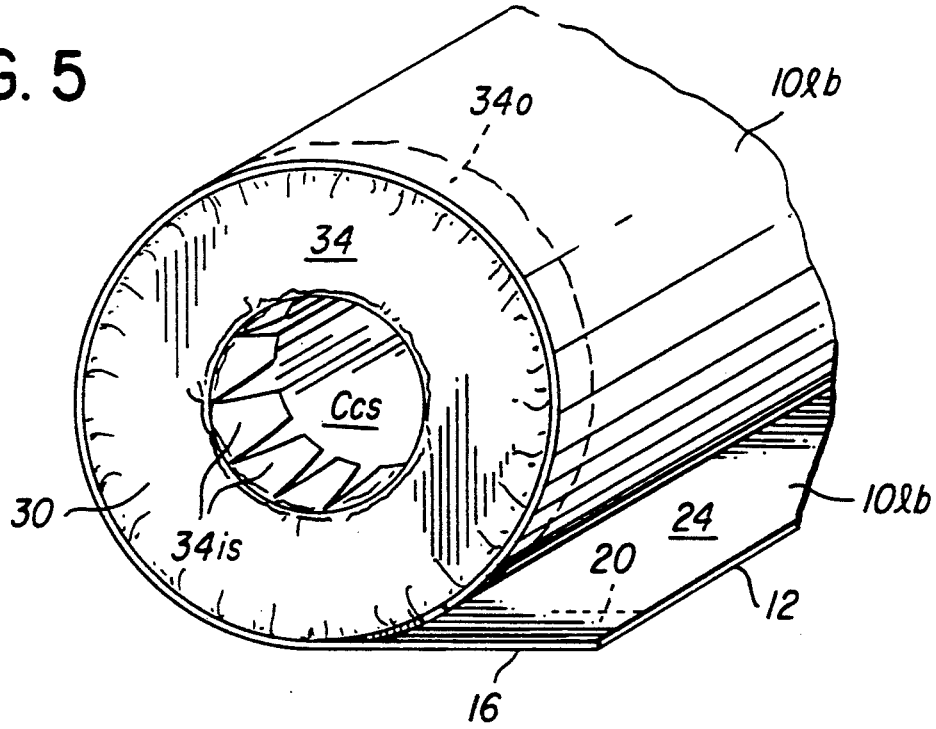

As indicated in FIG. 5, the folded outer annular marginal portions 34*o* of both end cap cover elements 34 are thus light-tightly secured between the respective lateral marginal portions 20 and 22 of the first and second leader convolutions.

Figure 6:
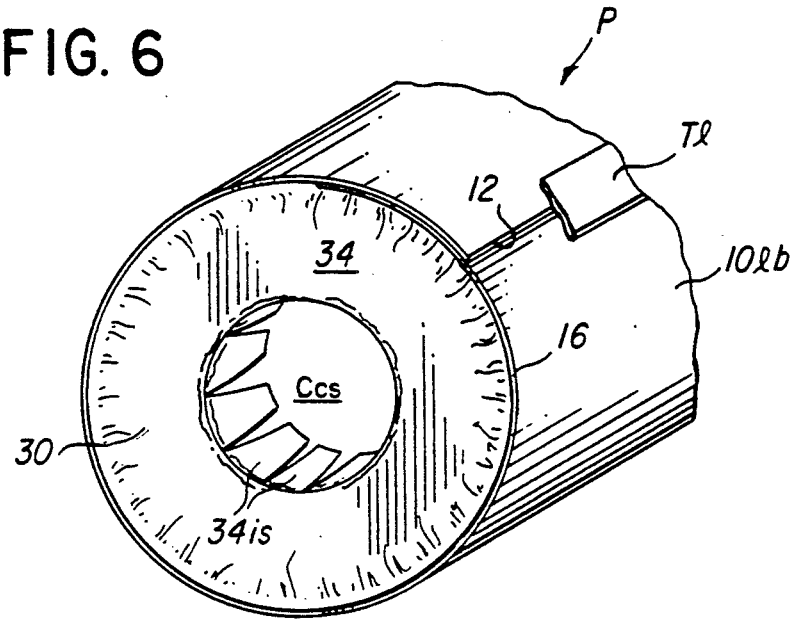

With the leader fully wound about the roll, as shown in FIG. 6, its leading end 12 is then removably secured, e.g., by adhesive tape Tl, to an adjacent portion of the second leader convolution.

Figure 7:
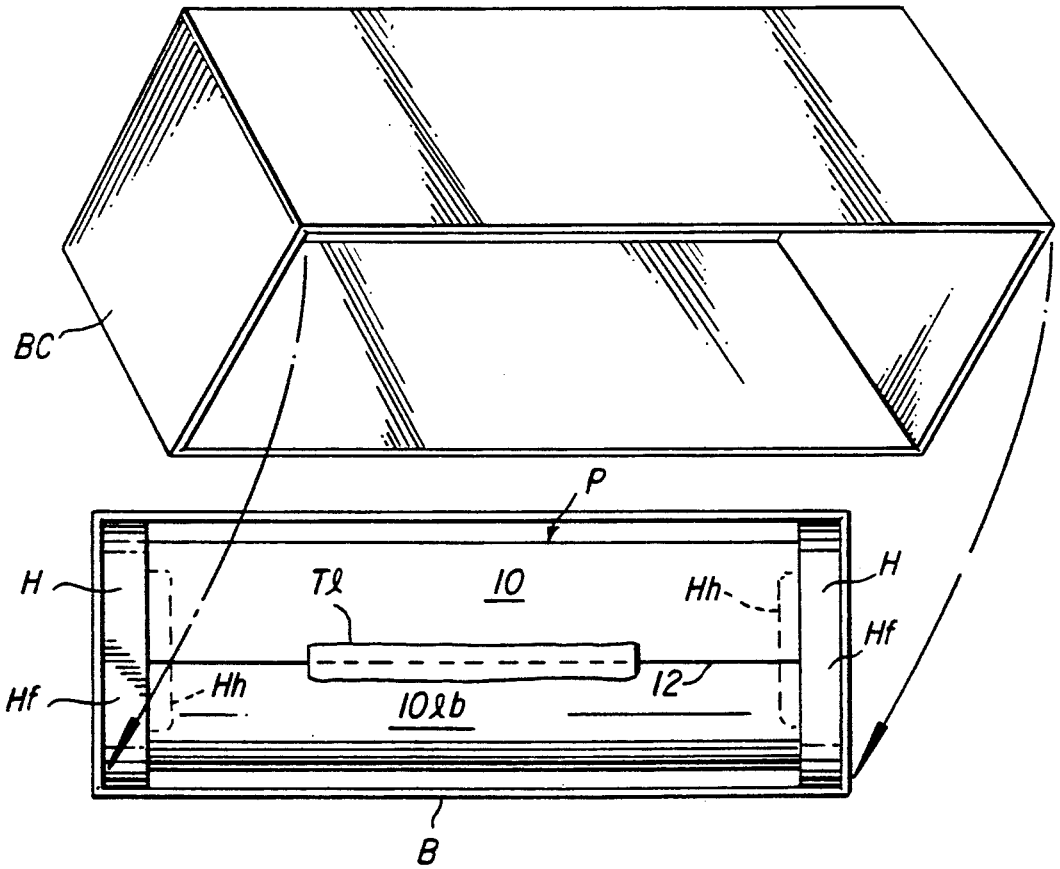
FIG. 7 is a perspective view of the web roll and package components shown in FIGS. 1–6, depicting the roll as light-tightly enclosed by those components when fully applied thereto, and further depicting the packaged roll as supported by a pair of hub members in an open-topped container with a mating cover positioned thereover to close the container.

The resulting package P, light-tightly enclosing roll R, is partially shown in FIG. 6 and fully shown in FIG. 7. In FIG. 7, the packaged roll is shown supported by a pair of hub members H having hubs Hh inserted into the roll core open ends and hub flanges Hf snuggly nested in an open-topped rectanguloid box B, with a mating box cover BC positioned thereover to close the box for shipping, handling, and/or storage.

In use, after removing package P from its shipping box and positioning it in a light-tight cassette (not shown) for use in cooperating apparatus, e.g., image-setting apparatus, the user, having removed the tape Tl and threaded the leader leading end through the cassette exit slot, simply pulls the leader completely out of the cassette, removes the tape Tt, and discards the leader. In the process of pulling the leader out, the leader is withdrawn tangentially from the roll as its outer and inner convolutions are unwound. Since no part of the leader is sealed to the end caps, the folded end cap cover element outer annular marginal portions 34*o* are simply unfolded radially outwardly as the leader inner convolution is unwound and pulled away. The thus-unfolded end cap portions 34*o* remain unfolded as the photosensitive web W is withdrawn from the roll.

It will now be appreciated that the aforementioned object of this invention has been achieved by fulfilling the stated need therefor, and by providing the following benifits vis-a-vis the prior art:

For the Manufacturer (a) Faster, more efficient production, with no heatsealing of the leader required; and (b) Greater production flexibility, as no new hardware is required to light-seal a roll of different diameter, because of the variability allowed in the amount of end cap material (portion 34*o*) that must be folded over the roll ends to provide a light-tight fold/wrap.

For the User (a) No need for equipment modification to accomodate this package, because the increase in axial length is minimal; and (b) As a result of greater manufacturing flexibility noted above, more roll-product formats can be offered in shorter tim periods, giving the user more product options and faster response times.

Although the present invention has been described with particular reference to its preferred embodiment illustrated herein, it will nonetheless be understood by those skilled in the pertinent art that variations and modifications thereof can be effected within the scope of this invention as defined by the claims set forth below.

We claim:

1. A method for light-tightly enclosing a roll of photosensitive material in a package that may be readily opened to dispense such material in cooperating apparatus, said roll including an elongate photosensitive web of predetermined width wound longitudinally about a hollow cylindrical core and terminating in an outermost end thereof, said web so wound about said core defining diametral and circumferential dimensions and circumferential and opposite end surfaces of said roll, said core having opposite open ends defining an axial length therebetween substantially equal to said web predetermined width, each of said core ends having an inner diameter defining an inner circumferential surface extending axially inwardly therefrom, said method comprising the steps of:

providing a flexible opaque leader having leading and trailing ends defining a longitudinal dimension therebetween equal to at least twice said roll circumferential dimension, and having opposite lateral edges defining a leader width therebetween substantially equal to said web predetermined width, said leader further having opposite lateral marginal portions extending longitudinally along and inwardly of said opposite lateral edges, respectively, and a medial portion extending longitudinally between said lateral marginal portions;

providing in each of said lateral marginal portions a recess extending inwardly from the adjacent one of said lateral edges and spaced longitudinally from said trailing end by substantially said roll circumferential dimension;

joining said trailing end to said web outermost end;

winding a first stretch of said leader longitudinally about said roll circumferential surface through a first convolution of said leader begining at said trailing end and ending at said recesses in said lateral marginal portions, leaving a second stretch of said leader as yet unwound;

providing a pair of foldable, disk-shaped, opaque end caps adapted to cover said roll opposite end surfaces respectively, each of said end caps including a central round opening with a diameter less than said core inner diameter and an annular opaque cover element surrounding said opening and extending radially outwardly therefrom to a circular periphery with a diameter greater than said roll diametral dimension, said cover element having an inner annular marginal portion extending radially outwardly from said opening to an extent substantially commensurate with said core inner diameter and an outer annular marginal portion extending radially inwardly from said periphery to an extent substantially commensurate with said roll diametral dimension;

placing each of said end caps in substantially concentric covering relation to a respective one of said roll opposite end surfaces;

folding said inner annular marginal portion of each end cap cover element axially inwardly inside a respective one of said core ends and sealing that portion, so folded, to said inner circumferential surface thereof;

folding said outer annular marginal portion of each end cap cover element axially inwardly of a respective one of said roll end surfaces and radially inwardly upon the adjacent one of said leader lateral marginal portions of said first leader convolution, said recesses in said lateral marginal portions providing requisite clearance for said leader medial portion therebetween to pass between said folded outer annular marginal portions where said first leader convolution ends; and winding said second stretch of said leader longitudinally about said folded outer annular marginal portions, and said first leader convolution medial portion therebetween, through a second convolution of said leader begining at said recesses and ending a circumferential distance therebeyond equal to at least said roll circumferential dimension;

whereby said folded outer annular marginal portions of said end cap cover elements are light-tightly secured between said lateral marginal portions of said first and second leader convolutions.

2. The method claimed in claim 1 including providing said leader so that each lateral marginal portion thereof extends inwardly from said adjacent lateral edge by an amount at least as great as the radial extent of said outer annular marginal portion of each end cap cover element.

3. The method claimed in claim 2 further including providing said recess in each lateral marginal portion so that said recess extends inwardly through said lateral marginal portion at least to said medial portion.

4. The method claimed in claim 1 including providing said recess in each lateral marginal portion so that said recess extends inwardly from said lateral edge by an amount greater than the radial extent of said outer annular marginal portion of each end cap cover element.

5. The method claimed in claim 1 including providing each end cap cover element so that said inner annular marginal portion thereof has means for facilitating the folding of that portion axially inwardly inside one of said core ends and the sealing of that portion to said inner circumferential surface thereof.

6. The method claimed in claim 5 further including providing said inner annular marginal portion so that said facilitating means includes a plurality of substantially radial lines of weakness therein

7. The method claimed in claim 5 further including providing said inner annular marginal portion so that said facilitating means includes a plurality of substantially radial lines of cleavage dividing that portion into separately foldable and sealable segments.

8. The method claimed in claim 7 further including providing said facilitating means by die-cutting said lines of cleavage through said inner annular marginal portion.

9. The method claimed in claim 1 further comprising the step of removably securing said leader leading end to an adjacent portion of said second leader convolution.

10. The method claimed in claim 9 wherein said securing step includes adhesively securing said leading end to said portion of said second convolution.

* * * * *